US012410984B2

(12) United States Patent
Howard

(10) Patent No.: US 12,410,984 B2
(45) Date of Patent: Sep. 9, 2025

(54) ADAPTABLE HANDGUARD

(71) Applicant: Mason Howard, Arlington, VA (US)

(72) Inventor: Mason Howard, Arlington, VA (US)

( * ) Notice: Subject to any disclaimer, the term of this patent is extended or adjusted under 35 U.S.C. 154(b) by 56 days.

(21) Appl. No.: 18/417,154

(22) Filed: Jan. 19, 2024

(65) Prior Publication Data

US 2025/0237457 A1 Jul. 24, 2025

(51) Int. Cl.
*F41A 21/48* (2006.01)
*F41A 3/66* (2006.01)
*F41C 23/16* (2006.01)

(52) U.S. Cl.
CPC ..... *F41A 21/48* (2013.01); *F41A 3/66* (2013.01); *F41C 23/16* (2013.01)

(58) Field of Classification Search
CPC ..... F41A 21/28; F41A 23/16; F41C 23/16
See application file for complete search history.

(56) References Cited

U.S. PATENT DOCUMENTS 8,087,194 B1 * 1/2012 Vuksanovich ..... F41A 21/481 42/75.01
9,702,652 B1 * 7/2017 Jackson ..... F41A 21/482
10,012,460 B1 * 7/2018 Vankeuren, III ..... F41A 3/66
10,302,388 B1 * 5/2019 Brown ..... F41C 23/16
10,436,549 B1 * 10/2019 Taylor ..... F41C 23/16
10,670,369 B1 * 6/2020 Ding ..... F41A 3/66
2007/0033851 A1 * 2/2007 Hochstrate ..... F41A 5/18 42/75.01
2007/0199435 A1 * 8/2007 Hochstrate ..... F41A 5/26 42/72
2008/0301994 A1 * 12/2008 Langevin ..... F41C 23/16 42/71.01
2009/0013579 A1 * 1/2009 Fluhr ..... F41C 23/16 42/71.01
2010/0175293 A1 * 7/2010 Hines ..... F41C 23/16 42/71.01
2011/0126443 A1 * 6/2011 Sirois ..... F41C 27/00 42/90
2012/0132068 A1 * 5/2012 Kucynko ..... F41A 5/18 42/71.01
2015/0059221 A1 * 3/2015 Bero ..... F41A 3/72 42/16
2015/0316347 A1 * 11/2015 Shea ..... F41C 23/16 42/75.02
2016/0091276 A1 * 3/2016 Miller ..... F41C 23/16 42/75.02
2016/0348990 A1 * 12/2016 Steil ..... F41A 21/00
2018/0266789 A1 * 9/2018 Schatz ..... F41C 23/16
2019/0086175 A1 * 3/2019 Karagias ..... F41A 21/482
2019/0170476 A1 * 6/2019 Hiler, Jr. ..... F41A 21/482
(Continued)

*Primary Examiner* — Joshua E Freeman
(74) *Attorney, Agent, or Firm* — Braxton Perrone, PLLC; Bobby W. Braxton; Gregory Perrone

(57) ABSTRACT

A system and method for an adaptable handguard. The system includes a receiver adapter configured to couple with a firearm via an adapter nut. The receiver adapter has a tapered inner wall and the adapter nut has a tapered outer wall. There is a barrel adapter assembly which couples to a barrel. The barrel assembly has a tapered downstream outer wall. There is a housing which fits around the barrel adapter assembly. The housing has one or more latches to couple with the receiver adapter. This allows for quick and easy changing of barrels once the system is installed.

17 Claims, 10 Drawing Sheets

(56) References Cited

U.S. PATENT DOCUMENTS

| | | | | |
|---|---|---|---|---|
| 2021/0180904 | A1* | 6/2021 | Bray | F41A 3/66 |
| 2021/0293498 | A1* | 9/2021 | Underwood | F41A 3/66 |
| 2023/0020437 | A1* | 1/2023 | Markut | F41C 23/16 |
| 2023/0194202 | A1* | 6/2023 | Afshari | F41A 21/48 42/75.02 |
| 2023/0221092 | A1* | 7/2023 | Underwood | F41A 21/48 42/71.01 |

* cited by examiner

ADAPTABLE HANDGUARD

BACKGROUND OF THE INVENTION

Technical Field

The present invention relates to a system and method for changing handguards and barrels on a firearm.

Description of Related Art

There are multiple barrel sizes for firearms. Different barrels serve different purposes. Consequently, there is a need to be able to quickly and easily change barrels on a firearm.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1A:
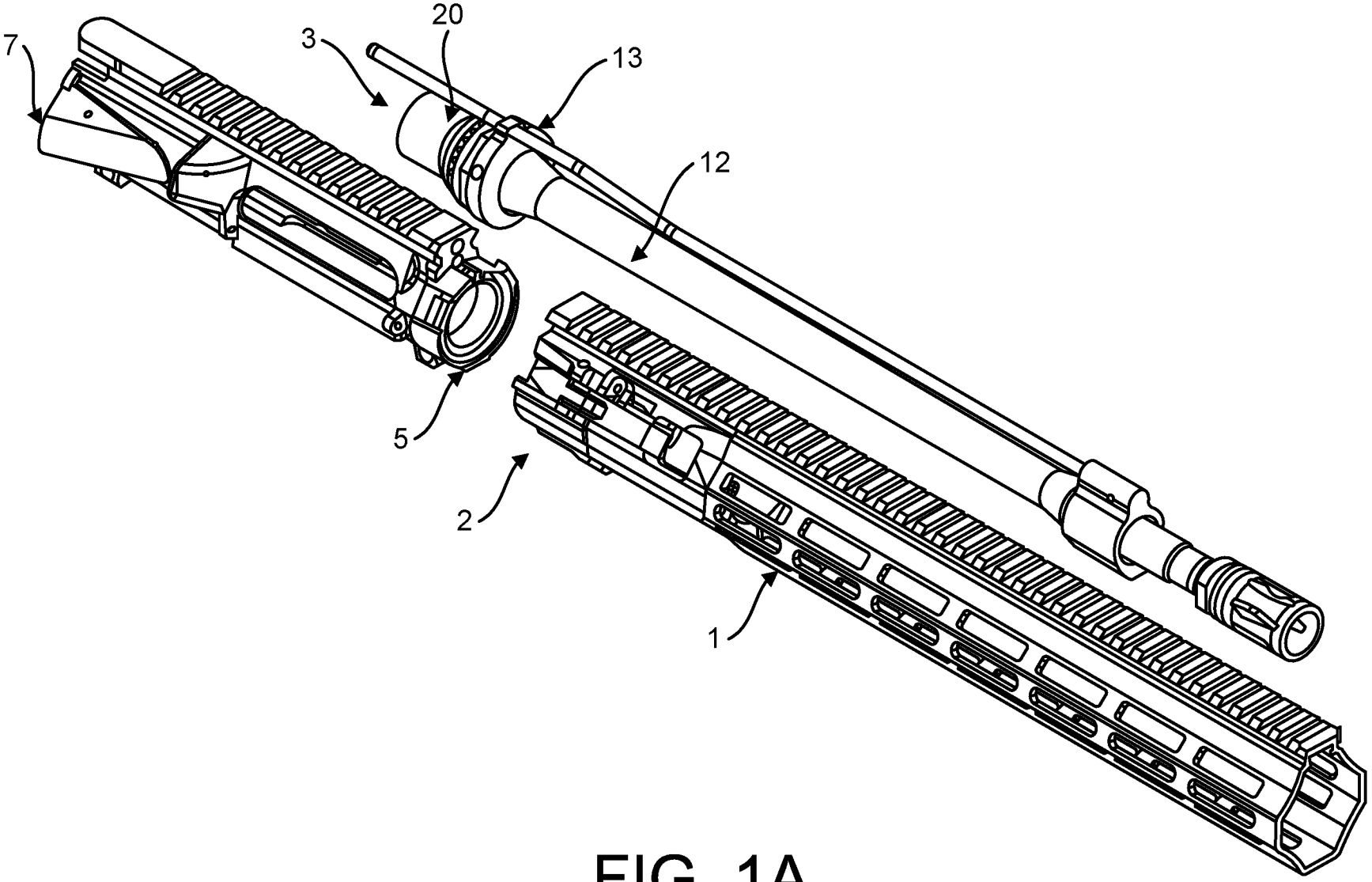
FIG. 1A is a perspective exploded view of an adaptable barrel system in one embodiment.
Figure 1B:
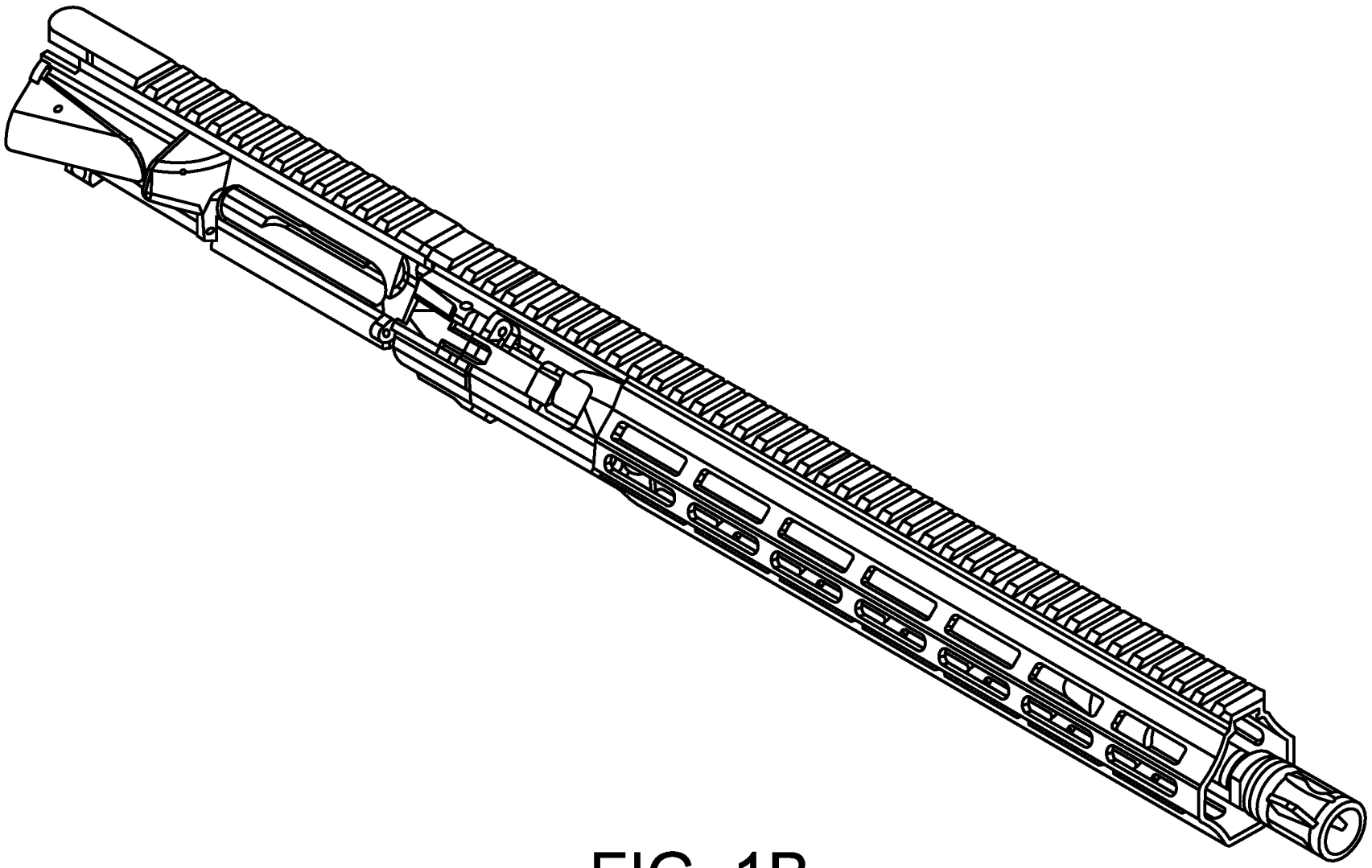
FIG. 1B is a perspective view of an adaptable barrel system in one embodiment.

FIG. 1A is a perspective exploded view of an adaptable barrel system in one embodiment. FIG. 1B is a perspective view of an assembled adaptable barrel system in one embodiment.

As shown is a barrel 12. The barrel 12 can comprise various lengths, calibers, etc. The barrel can comprise various calibers including 223 or 556. The barrel 12 can also have various lengths. In one embodiment the user wants to change the type of barrel 12 associated with a specific firearm. The user can want to change the length of the barrel 12, the caliber, etc. In one embodiment the system and method discussed herein allows the swapping or replacing of a barrel without any additional tools or permanent alterations to the firearm. In one embodiment, the system requires minimal tools to install. However, once installed, no tools are required to switch barrels. As an example, various tools may be needed to install the system onto the firearm. However, once installed, the user can switch from a 300 Blackout to a 556 barrel without requiring any tools.

As depicted is the upper receiver 7 of a firearm with an AR-15 platform. While an AR-15 platform is discussed, this is for illustrative purposes only and should not be deemed limiting. Virtually any firearm platform which has a removable barrel can utilize the system discussed herein.

The system, as shown, includes a handguard 1. The handguard 1 covers the barrel 12. The handguard 1, can have various accessories such as a rail as depicted. The handguard 1 couples to the receiver with a housing 2, which will be discussed in more detail below herein.

Coupled to the barrel 12 is the barrel adapter 13, which will be discussed in more detail in FIG. 2. The barrel adapter 13 couples to the receiver 7 via a handguard receiver adapter 5.

Figure 2:
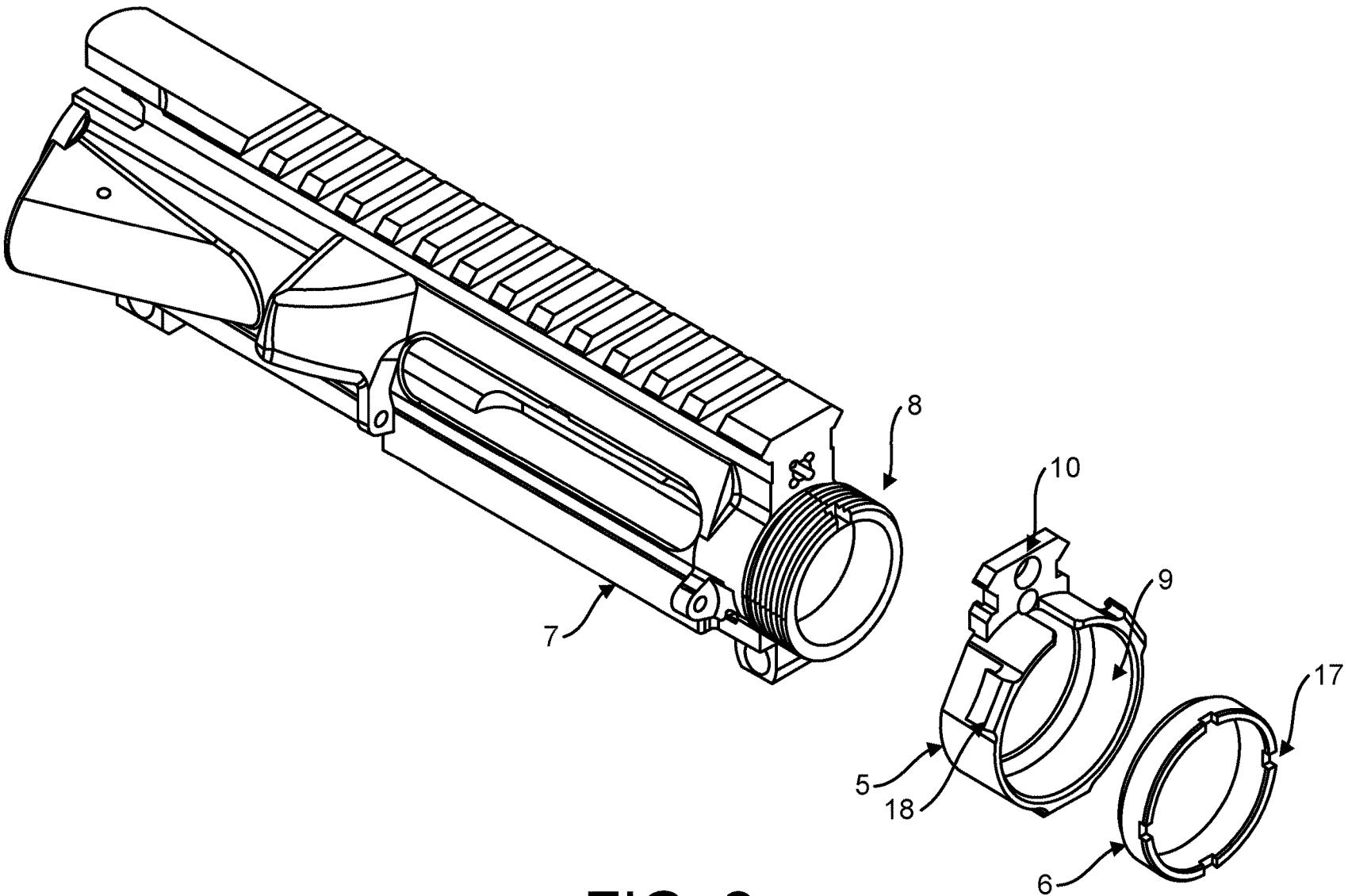
FIG. 2 is a perspective view of a handguard receiver adapter in one embodiment.

Turning to FIG. 2, FIG. 2 is a perspective view of a handguard receiver adapter in one embodiment. As depicted, the upper receiver 7 has threading 8. The threading 8 allows various items to be coupled to the receiver. In one embodiment, the handguard adapter receiver 5 does not have threads. Instead, it slides as far upstream as possible. Upstream and downstream refer to relative locations on a firearm. The end closer to the trigger is an upstream end whereas the end closes to the end of the barrel where the projectile exits is the downstream end. Once the handguard adapter receiver 5 has been positioned as upstream as possible, then the threading 8 of the receiver 7 couples to threading on the adapter nut 6. The adapter 6 maintains the handguard receiver adapter 5 in the desired location. Furthermore, this scenario maintains the precise location, not just along the upstream/downstream axis but also up/down, and left/right, because of a tapered surface on both the nut 6 and the adapter receiver 5.

Figure 3:
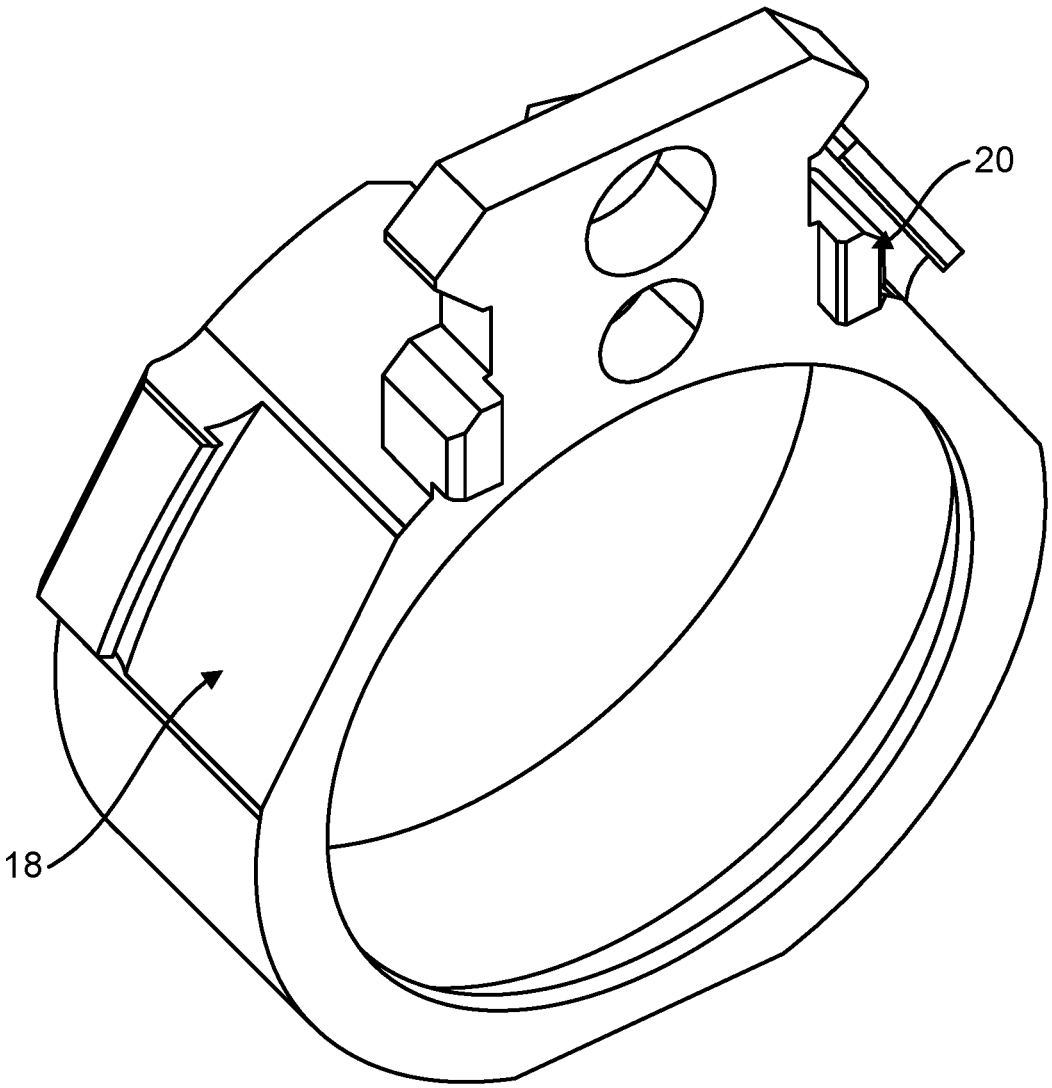
FIG. 3 shows the reverse side of the receiver adapter in one embodiment.

In one embodiment the handguard adapter receiver 5 has ears 20 on the upstream end which prevent the adapter receiver 5 from rotating. The ears are best shown in FIG. 3 which shows the reverse side of the receiver adapter 5. The ears 20 fit within the void of the upper receiver 7 which prevents the receiver adapter 5 from rotating. Further, as shown, the adapter receiver 5 comprises adapter hooks 18 positioned along the periphery of the adapter receiver 5. As shown, these are equally spaced about 120 degrees removed from one another. This allows engagement with the housing 2 as will be discussed in more detail.

Figure 4:
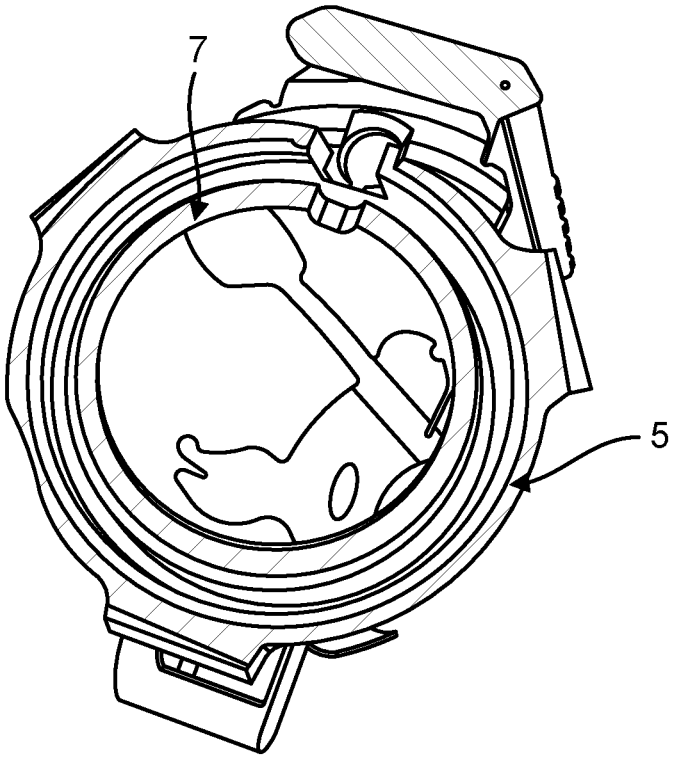
FIG. 4 is a front perspective view of the receiver adapter in one embodiment.

Turning back to FIG. 2, as shown, the adapter nut 6 comprises wrench couplers 17 which allow a wrench to engage, rotate, and tighten the adapter nut 6. In one embodiment the adapter nut 6, like the receiver adapter 5, comprises a tapered inner wall. This allows the two components to properly align in proper fit. When a tight fit is achieved, as a result of compression, the result is a snug and tight fit with interplay and movement between parts minimized or eliminated Turning to FIG. 4, FIG. 4 is a front perspective view of the receiver adapter 5 being positioned on the upper receiver 7. As noted, the upper receiver 7 has threads, whereas, as depicted, the receiver adapter 5 does not. As can be seen, there is a void between the receiver 7 and the receiver adapter 5. This results in play as the receiver adapter 5 can be moved relative to the receiver 7. The fixed diameter barrel extension 21 fits within the fixed diameter of the bore of the receiver 7. The clearance between these parts can be as large or larger than 0.0013 inches. Taking the 0.0013 inches and dividing by 2 to obtain a radius, this is about 0.00065 inches in any direction surrounding the barrel can move within the bore of the receiver 7. This undesirable distance results is play of the barrel. This play is reduced by the tapering of the adapter 5 and the adapter nut 6, as described below. In other embodiments the gap can be as large as 0.0041 inches, resulting in considerable play. As noted, this can be reduced with the system discussed herein.

The receiver adapter 5, as noted, has a tapered inner wall. The adapter nut 6 has a tapered outer wall. Thus, when the adapter nut 6 is tightened along the threads 8 of the receiver 7, the tapers of the receiver adapter 5 and the adapter nut 6 meet and align. This ensures proper centering of the receiver adapter 5 relative to the receiver 7 and reduces play between the components. This results in a structurally complete and sound assembled product.

Turning back to FIG. 2, the handguard adapter receiver 5, as shown, has an exhaust hole 10. The exhaust hole 10 can align with other holes in other components to provide a path for the exhaust. Further, this exhaust hole provides an additional opportunity to secure and hold the receiver adapter 5 in the desired location. Thus, the adapter receiver 5 acts as a brace for the gas tube which can become jostled and loose. The adapter receiver 5, when it includes an exhaust hole 10, eliminates the need for a separate gas tube brace. While a gas tube has been described, this is for illustrative purposes only. The adapter receiver 5 can accommodate other items or configurations depending upon the specific firearm.

Figure 5:
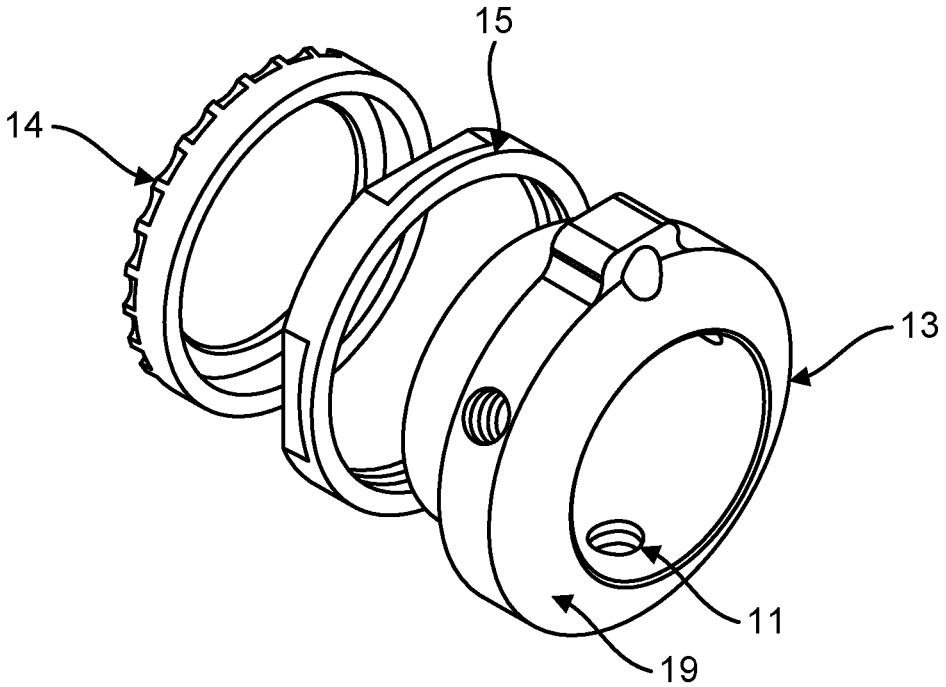
FIG. 5 is a perspective view of the barrel adapter assembly in one embodiment.

Turning to FIG. 5, FIG. 5 is a perspective view of the barrel adapter assembly in one embodiment. The barrel adapter 13 attaches to the barrel extension 21. As noted (and shown in FIG. 1A), the barrel has a barrel extension 21 located on the downstream end of the barrel 12.

The assembly, as shown in one embodiment, comprises a depth ring 14, a lock ring 15, and barrel adapter 13. As shown, and in one embodiment, the depth ring 14 and the lock ring 15 both thread onto the barrel adapter 13. When installed together, the depth ring 14, lock ring 15, and the barrel adapter 13 are referred to collectively as the barrel adapter assembly. The barrel adapter 13 also has outer threads on the upstream post of the barrel adapter 13. The depth ring 14 and the lock ring 15, in one embodiment, comprise internal threads which engage and couple with the external threads on the barrel adapter 13. The internal edge of the depth ring 14 makes contact with the barrel extension 21. The width of the barrel adapter assembly can be adjusted by manipulating the depth ring 14 and the lock ring 15 relative to the barrel adapter 13. When tightened as tight as possible, the width of the barrel adapter assembly is tight and compact. As used in this example, width is measured as the upstream and downstream axis. The width can be increased by loosening the depth ring 14 and or the lock ring 15 relative to the barrel adapter 13. A more compact barrel adapter assembly occupies less space within the housing 2. If the resulting coupling has too much play or slack, the barrel adapter assembly can be manipulated to increase the width. Increasing the width of the barrel adapter assembly results in more space being occupied within the housing 2. This results in less play and less slack. Thus, the ability to increase the size of the barrel adapter assembly, and thus the amount of space it occupies within the handguard, allows for controlling the slack and play within the handguard.

To install, the barrel adapter assembly is placed the furthest upstream possible on the barrel 12. In one embodiment, the barrel adapter assembly is placed adjacent the barrel adapter 21.

Once a desirable position of the rings has been set it is slid onto the barrel as far upstream as possible, the adapter can be set in the location. Initially the rings 14, 15 are loose in relation to the post on the barrel adapter assembly 13. They can be tightened, in one embodiment, via wrenches. As noted, the adapter assembly 13 is placed as far upstream as possible on the barrel 12 or barrel extension 21. In one embodiment, and as depicted, the barrel adapter 13 has screw ports 11 located within the barrel adapter 13. In one embodiment the screw ports 11 are equally spaced along the barrel adapter 13. As shown, they are approximately 120 degrees separated along the barrel adapter 13. Screws, or the like, can be inserted via the screw ports 11, and tightened to fix the adapter 13 to the barrel 12 in the desired location. Once this occurs, compression is set. No further tools are necessary for the installation at this point.

In one embodiment, the downstream face of the barrel adapter 13 is tapered. This creates a neutral position for the handguard to match up to, which once under compression, removes any error from tolerances of the two mating parts. Additionally, this likely positions the barrel where it was previously. Further, it allows for a natural self-centering concept.

In one embodiment the downstream face 10 is tapered along the entire periphery of the barrel adapter's outer wall. As shown, the taper begins inwardly at a larger diameter and expands to a reduced diameter at the end of the taper. As noted, the taper allows the barrel adapter 13, and thus the barrel adapter assembly, to find a centered and neutral position within the handguard.

Figure 6:
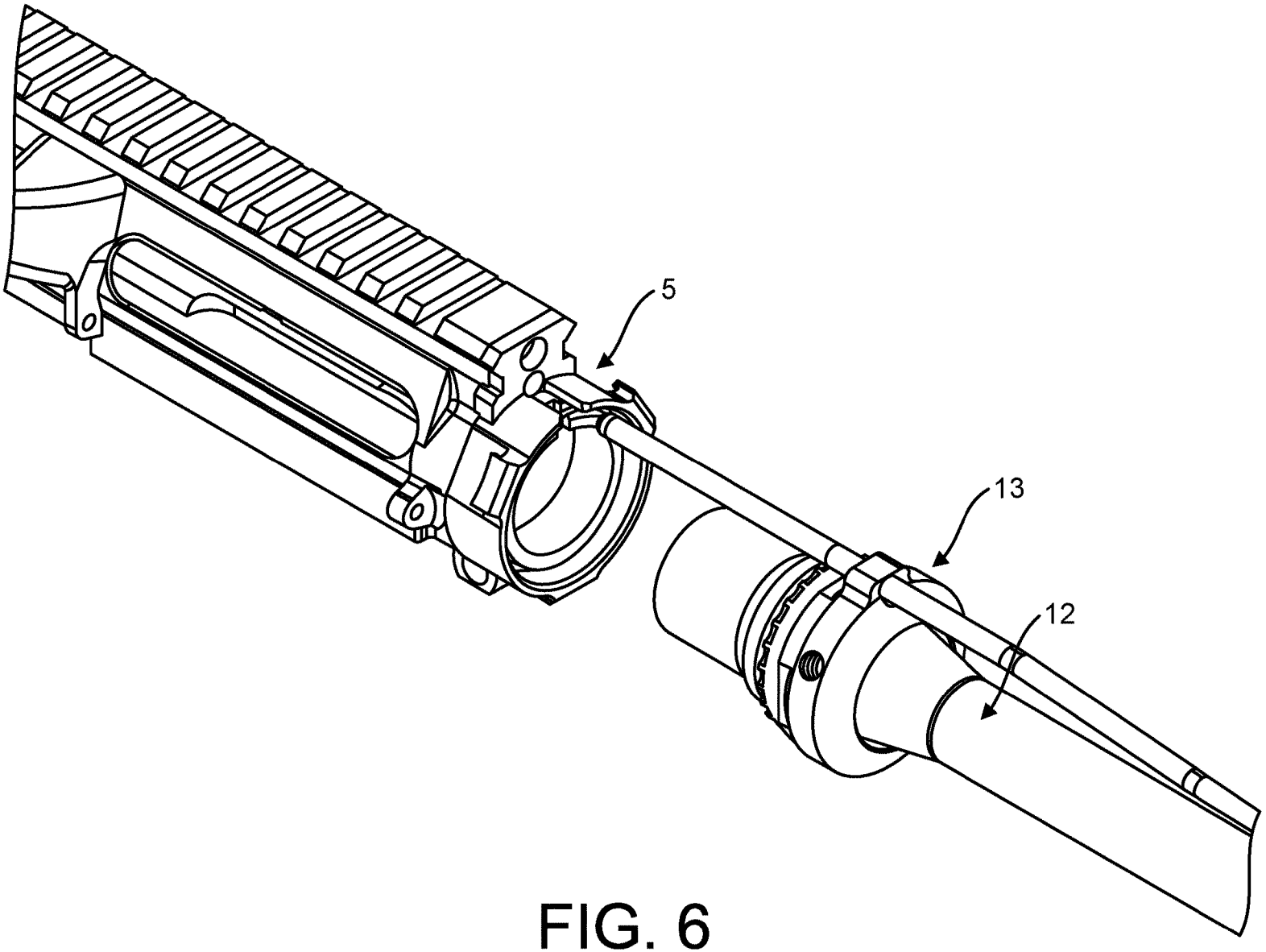
FIG. 6 is a perspective view of the adaptable barrel system in one embodiment.

Turning to FIG. 6, FIG. 6 is a perspective view of the adaptable barrel system in one embodiment. As can be seen the barrel 12, and the barrel adapter 13 are properly aligned with the handguard receiver adapter 5. The barrel extension 21 will be received by the receiver 7.

Figure 7:
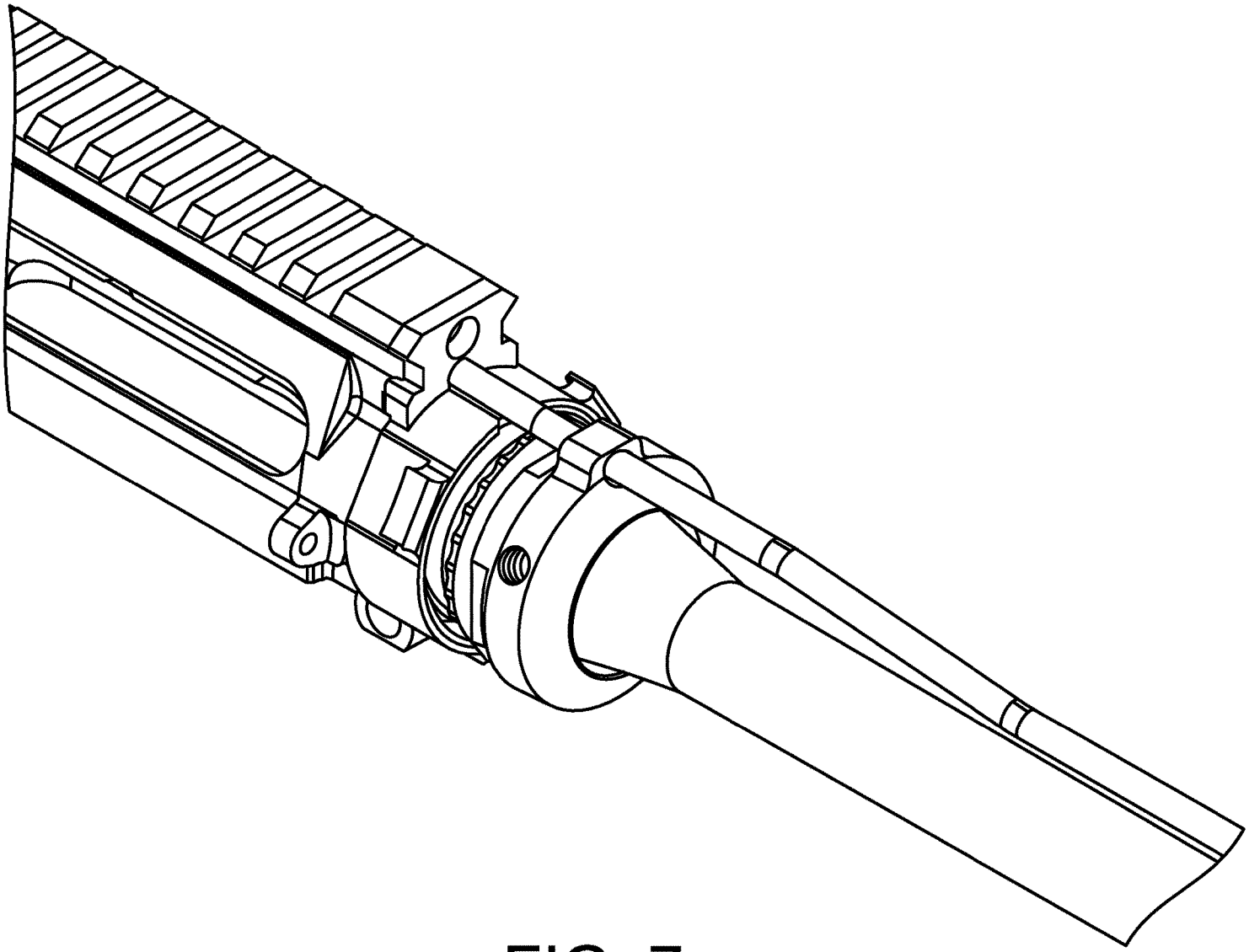
FIG. 7 is a perspective view of the assembled adaptable barrel system in one embodiment.

FIG. 7 is a perspective view of the assembled adaptable barrel system in one embodiment. As can be seen, the adapter assembly is brought adjacent to the handguard receiver adapter 5.

It should be noted that while one embodiment has been shown for a variable-width barrel adapter assembly, this is for illustrative purposes only and should not be deemed limiting. In other embodiments, the system utilizes a fixed width barrel adapter assembly. In one such embodiment, rather comprising adjustable pieces which can expand or shorten the width, the barrel adapter assembly comprises a single piece which is not adjustable. In some embodiments, and some handguards, a specific width will suffice. Thus, in such embodiments the fixed barrel adapter assembly need not be adjustable. In some embodiments, however, the downstream end still has a tapered shape to allow it to be received within the housing 2.

Figure 8:
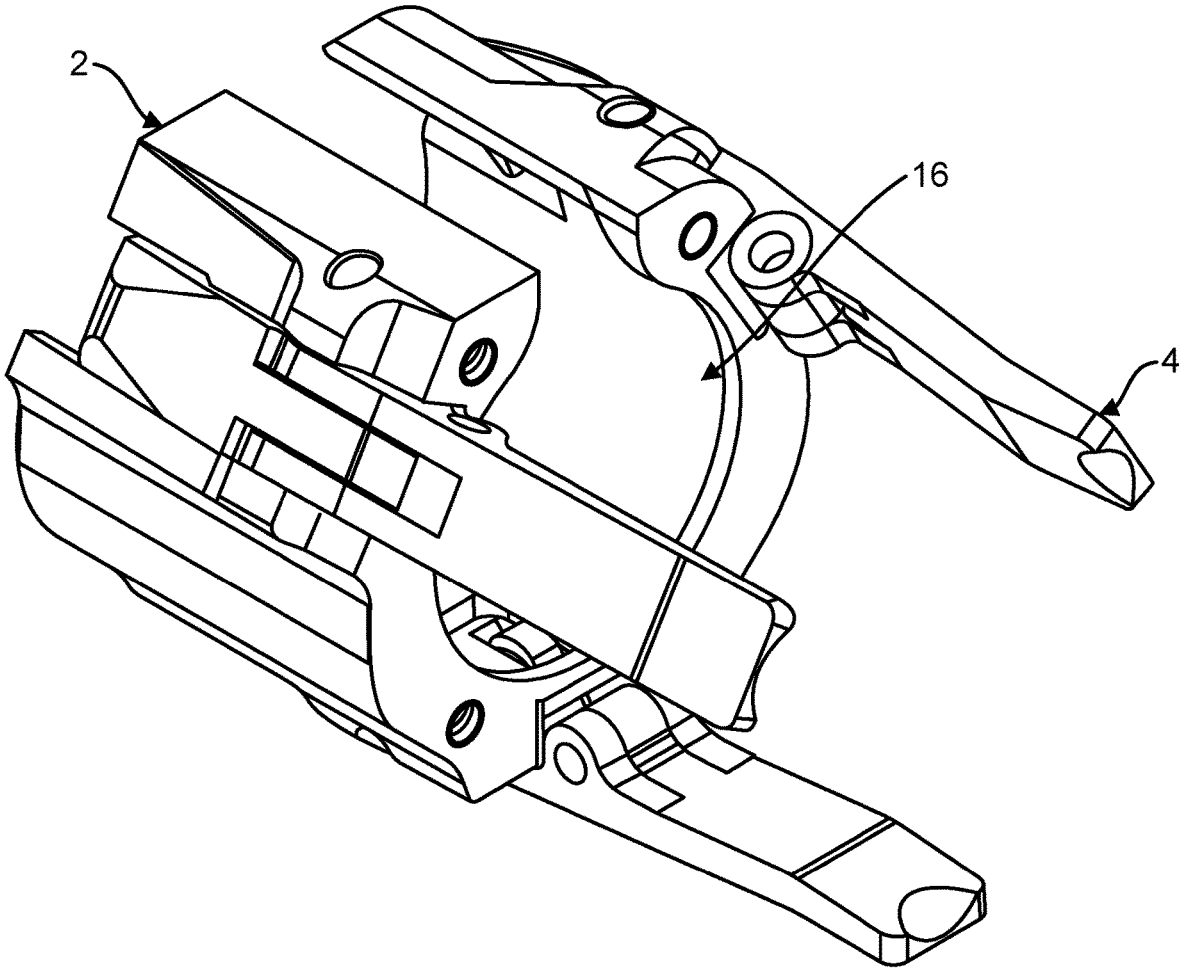
FIG. 8 is a perspective view of the housing in one embodiment.

Turning to FIG. 8, FIG. 8 is a perspective view of the housing in one embodiment. As shown the housing 2 has a plurality of coupling holes to connect to the handguard 1. This can be accomplished via any method or device known in the art including screws. The handguard 1 has not been illustrated in FIG. 6 to highlight the housing 2.

As shown, the housing 2 has three over center compression toggle latches 4. While three is shown, this is for illustrative purposes only and should not be deemed limiting. The three are spread equally along the outer periphery of the housing 2. This allows the latches 4 to be equally spaced at about 120 degrees from one another. This orientation, in some embodiments, provides for an even spread of compression. Many AR-15 barrels are hand slide-in fit and have a lot of undesirable vertical play. Two latches, for example, without more and oriented on the side of the embodiment, do not decrease the vertical play problem. However, by having three latches 4 spread evenly, there is compression in the vertical dimension as well, and the play in the vertical dimension is reduced. In one embodiment, the latches 4 move up and down on the pin as it rotates, this makes the latches 4 want to move to the same location every time. Additionally, because the surfaces are tapered, the internal tapering of the housing 2 matches with the tapering of barrel adapter 13. If the internal surface of the housing 2 were not tapered, regardless of the amount of compression, the position might be microns off compared to the location of the previous removal. The interior tapering of the housing 2 reduces this problem since it matches with the barrel adapter 13.

In one embodiment, the latches 4 mate with the adapter hook 18 on the handguard receiver adapter 5. In one embodiment, and as shown, the latches 4 pivot. If an inward force is applied on a downstream end of the latches 4, the upstream end of the latches 4 pivot outwardly, disengaging from the adapter hook. In one embodiment the latches 4 comprises a biasing mechanism such as a spring. The latches can also pivot outwardly if they were not hooked into the receiver adapter.

Figure 9:
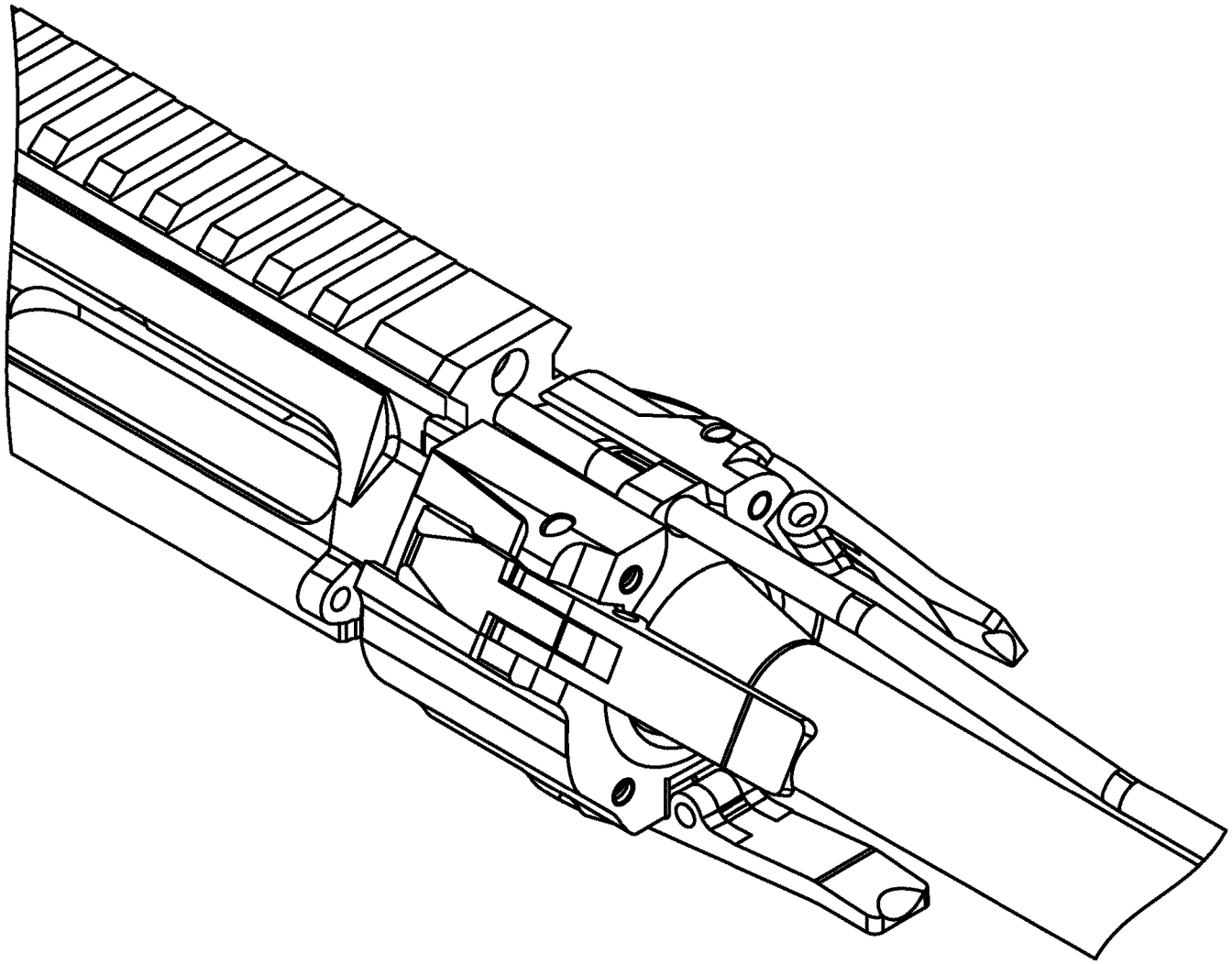
FIG. 9 is a perspective view of an assembled housing in one embodiment.
Figure 10:
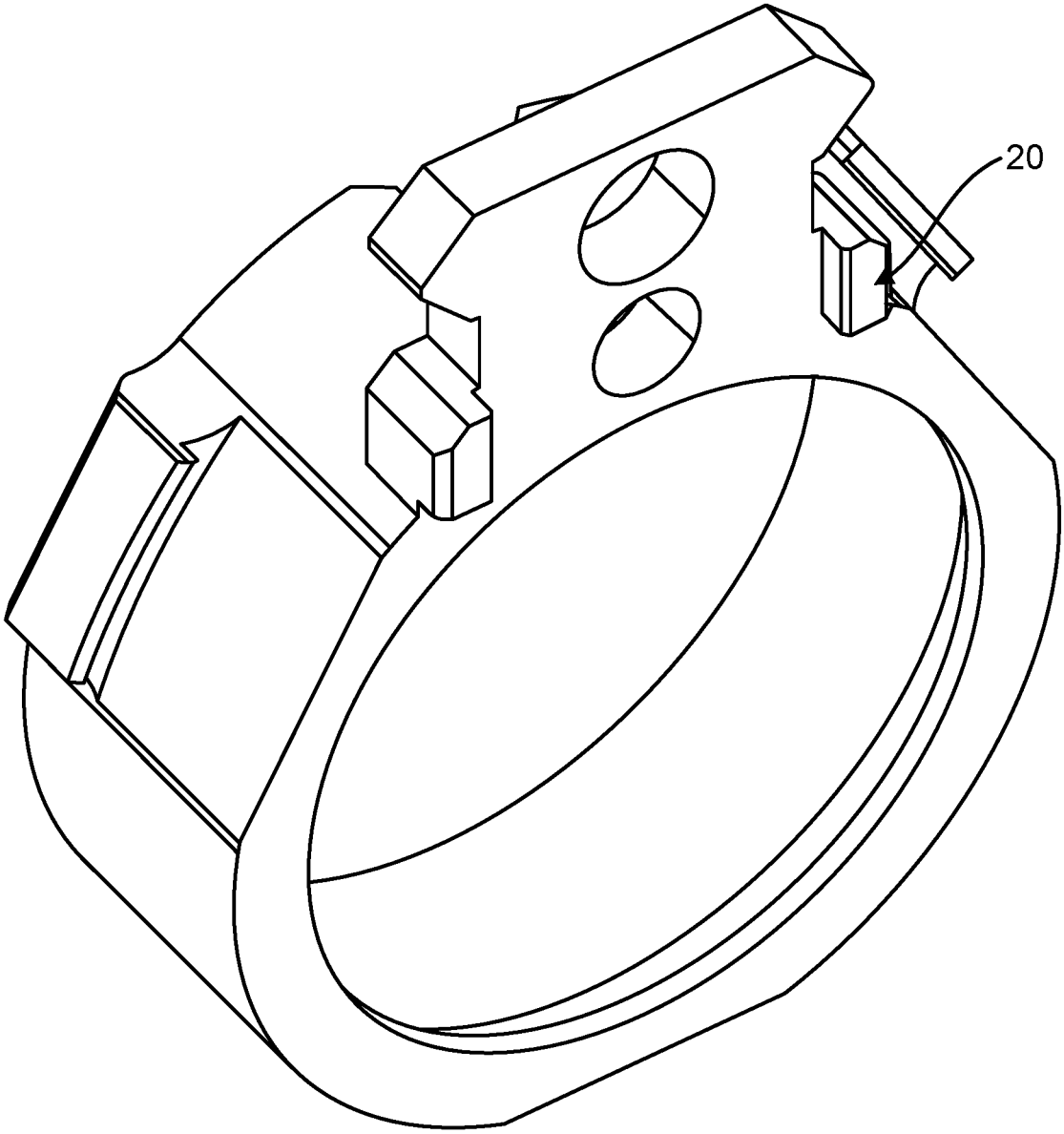
FIG. 10 is a perspective view of the adapter in one embodiment.

Turning to FIG. 9, FIG. 9 is a perspective view of an assembled housing in one embodiment. As can be seen, the housing 2 is coupled to the handguard receiver adapter 5 via the latches. This secures the barrel 12 in its desired, and operational, location. Thereafter, the handguard 1 can be positioned around the housing 2 and secured.

Now that a system has been described, a method of installing an adaptable handguard will be discussed. The method involves removing the existing barrel. This may involve the use of tools. Next, the receiver adapter 5 is coupled to a receiver such as via the adapter nut as described. The receiver adapter can have a tapered inner wall which mates with a tapered outer wall o the adapter nut. If necessary, a wrench or other device can be used to secure the adapter nut 6 to the receiver. In one embodiment, as noted, the receiver adapter 5 has ears 20 which keep the receiver adapter 5 in the desired location while the adapter nut 6 is tightened.

Next, the barrel adapter assembly is coupled to a new barrel, as previously described. It should be noted that any such barrel does not have a gas block on it yet. Any applicable AR15 gas block for the barrel in use will need to be installed after the barrel adapter 13, for example. In one embodiment the barrel adapter assembly is pushed as far upstream as possible. The width of the barrel adapter assembly, if adjustable, can be adjusted to determine a first width. Once set, set screws within the barrel adapter assembly can secure the barrel adapter assembly relative to the barrel.

Thereafter, the housing is secured over the barrel adapter assembly and coupled to the receiver adapter. The housing, in some embodiments, is already coupled to the handguard. In other embodiments, the handguard is coupled to the housing 2 subsequently. In some embodiments screws are used to couple the housing 2 to the handguard 1. When the housing was already secured to the handguard, there are no further steps which require a tool. The user can simply decouple the barrel adapter assembly from the receiver adapter and install a different barrel.

Once secured, the user can determine if the barrel 12 is properly and securely held within the handguard. If there is too much slack and play, or too much movement of the barrel 12 within the handguard, the user can decouple the housing 2. The user would then adjust the width of the barrel adapter assembly. If there was too much movement of the barrel, the width of the barrel adapter assembly can be increased. This results in more contact and more compression of the barrel adapter assembly within the housing 2. This results in less play. This process can be repeated until the barrel 12 is properly held and secured within the handguard 1.

In some embodiments due to the trial-and-error nature of adjusting the barrel adapter assembly, the housing 2 is repeatedly coupled and de-coupled. In doing so, the user must move the latches 4 out of the way to couple the housing 2. As such, in one embodiment the latches 4 comprise a spring or other biasing mechanism which moves the latches 4 out of the way when not engaged. When the latches 4 are out of the way, the user can move easily couple and position the housing 2 as necessary. Otherwise, the latches 4, which can be in the way must be manually moved and positioned so the housing 2 can be coupled.

The system and method discussed herein provides for the ability to swap barrels 12 without any permanent modifications to the firearms. The tools necessary are minimal-namely screw drivers for screws, and perhaps a wrench for the adapter nut 6. Furthermore, due to the tapering, the various components allow for precise placement and coupling. As noted, once the system is installed, no tools are necessary for removing the barrel. Instead, the housing 2 is removed, without the use of tools, and the barrel 12 can be removed.

The user can go from a full length rifle to a short closer quarter rifle. The user can also switch handguards to one with a larger inner diameter that can fit a suppressor underneath it, for example.

It should be noted that the housing 2 has been depicted as a separate component from the handguard 1. This is for illustrative purposes only and should not be deemed limiting. In one embodiment the handguard 1 and the housing 2 comprise a single component. In some embodiments the handguard and housing 2 are integrally made.

While the invention has been particularly shown and described with reference to a preferred embodiment, it will be understood by those skilled in the art that various changes in form and detail may be made therein without departing from the spirit and scope of the invention.

What is claimed is:

1. A system for a firearm, said system comprising:

a receiver adapter configured to couple with a firearm via an adapter nut, wherein said receiver adapter comprises a tapered inner wall;

a barrel adapter assembly which couples to a lock ring and a depth ring, wherein said barrel adapter assembly comprises a tapered downstream outer wall;

a housing comprising at least one latch to engage with said receiver adapter.

2. The system of claim 1 further comprising a barrel and an upper receiver, wherein said barrel engages with said barrel adapter assembly.

3. The system of claim 2 wherein said adapter assembly comprises screw ports whereby screws can contact said barrel and secure the adapter assembly in place along the barrel.

4. The system of claim 1 wherein said adapter nut comprises threads which couple to an upper receiver, and wherein said adapter nut comprises at least one wrench coupling.

5. The system of claim 1 wherein said receiver adapter comprises an exhaust hole through which a gas tube can be inserted.

6. The system of claim 1 wherein said receiver adapter comprises at least one adapter hook, and wherein said at least one latch of said housing engages and locks with said at least one adapter hook.

7. The system of claim 5 wherein said receiver adapter comprises three adapter hooks along its periphery, and wherein said housing comprises three latches to engage with said adapter hooks to couple said barrel adapter with said housing.

8. The system of claim 1 wherein said adapter receiver has ears on an upstream end.

9. The system of claim 1 wherein said barrel adapter assembly comprises a post with external threads, wherein said depth ring and said lock reach comprise internal threads with couple with said external threads on the post.

10. The system of claim 1 wherein said adapter nut has a tapered outer wall.

11. A method of installing a barrel on a firearm, said method comprising the steps of:

a. removing the existing barrel;

b. coupling a receiver adapter to a receiver via an adapter nut, wherein the receiver adapter has a tapered inner wall;

c. coupling a barrel adapter assembly to a new barrel, wherein the barrel adapter has a tapered downstream outer wall;

d. coupling a housing over said barrel adapter assembly to said receiver adapter.

12. The method of claim 11 wherein said receiver adapter comprises a plurality of hooks, and wherein said housing comprises a plurality of latches, and wherein said coupling of step d) comprises mating said latches with said hooks.

13. The method of claim 11 further comprising placing a handguard around said barrel, and coupling said handguard with said housing.

14. The method of claim 11 wherein said adapter nut comprises threading which mates with threading on a receiver.

15. The method of claim 11 wherein said coupling of step c) comprises inserting a gas tube through an exhaust hole located on the receiver adapter.

16. The method of claim 11 wherein said barrel adapter comprises a post with external threading, and wherein said depth ring and said lock reach comprise internal threads with couple with said external threads on the post, and wherein said coupling of step c) comprises pushing the barrel adapter as far as upstream on the barrel as possible.

17. The method of claim 11 comprising adjusting said depth ring and said lock ring to adjust compression on said barrel.

* * * * *